US008650984B2

(12) United States Patent
O'Neill

(10) Patent No.: US 8,650,984 B2
(45) Date of Patent: Feb. 18, 2014

(54) ELECTRONIC CLUTCH PEDAL ASSEMBLY HAVING VARYING RESISTANCE

(75) Inventor: Dan O'Neill, Chatham (CA)

(73) Assignee: KSR Technologies Co., Ridgetown (CA)

( * ) Notice: Subject to any disclaimer, the term of this patent is extended or adjusted under 35 U.S.C. 154(b) by 0 days.

(21) Appl. No.: 13/426,026

(22) Filed: Mar. 21, 2012

(65) Prior Publication Data

US 2012/0240716 A1 Sep. 27, 2012

Related U.S. Application Data

(60) Provisional application No. 61/466,041, filed on Mar. 22, 2011.

(51) Int. Cl.
*G05G 1/30* (2008.04)

(52) U.S. Cl.
USPC ..... 74/512

(58) Field of Classification Search
USPC ..... 74/512, 513, 514, 560; 200/61.89, 86.5
See application file for complete search history.

(56) References Cited

U.S. PATENT DOCUMENTS 1,810,103 A * 6/1931 Flagstad ..... 192/99 S
1,995,659 A * 3/1935 Trier ..... 92/92
2,827,800 A 3/1958 Brelsford
3,503,601 A * 3/1970 Wells ..... 267/169
3,774,471 A 11/1973 Pezza
4,800,774 A 1/1989 Hagiwara et al.
5,038,907 A * 8/1991 Baumann ..... 192/99 S
5,115,186 A * 5/1992 Reinartz et al. ..... 324/207.22
5,215,176 A * 6/1993 Hamann ..... 192/99 S
5,237,891 A 8/1993 Lundberg et al.
5,555,774 A 9/1996 Lauring et al.
6,186,025 B1 * 2/2001 Engelgau et al. ..... 74/512
6,253,635 B1 7/2001 Huber
6,393,934 B1 5/2002 Rixon et al.
6,454,075 B1 * 9/2002 Leuschke et al. ..... 192/99 S (Continued)

FOREIGN PATENT DOCUMENTS

WO 0066385 A1 11/2000
WO 0138151 A1 5/2001
WO 2011152557 A1 12/2011

OTHER PUBLICATIONS

International Search Report for related International Application; PCT/IB2012/000577; Jul. 5, 2012; 5 pages.

*Primary Examiner* — Vicky Johnson
(74) *Attorney, Agent, or Firm* — Gifford, Krass, Sprinkle, Anderson & Citkowski, P.C.

(57) ABSTRACT

The electronic clutch pedal assembly includes a housing bracket for mounting the pedal assembly to the vehicle, a pedal arm, and a biasing device. The pedal arm includes an upper end and a pedal pad at a lower end. The upper end of the pedal arm is pivotally supported within the housing bracket for movement along a pedal path between an undepressed position and a depressed position. The biasing device includes a first end cap pivotally attached to the housing bracket and a second end cap pivotally attached to the pedal arm. The biasing device includes a compressible member disposed between the first end cap and the second end cap. The compressible member biases the pedal arm towards the undepressed position. Upon depression of the pedal arm towards the depressed position, the compressible member compresses as the biasing device rotates to provide a variable pedal resistance over the pedal path.

20 Claims, 10 Drawing Sheets

(56) References Cited

U.S. PATENT DOCUMENTS

| | | | | |
|---|---|---|---|---|
| 6,523,433 | B1 | 2/2003 | Staker | |
| 6,626,061 | B2 | 9/2003 | Sakamoto et al. | |
| 6,679,366 | B2 * | 1/2004 | Tulaczko et al. | 192/99 S |
| 6,837,356 | B2 * | 1/2005 | Tulaczko et al. | 192/99 S |
| 7,082,853 | B2 | 8/2006 | Fujiwara | |
| 7,428,856 | B2 * | 9/2008 | Podkopayev | 74/560 |
| 7,503,236 | B2 | 3/2009 | Schlabach | |
| 7,770,491 | B2 | 8/2010 | Ritter et al. | |
| 2002/0056337 | A1 * | 5/2002 | Sundaresan et al. | 74/513 |
| 2006/0230875 | A1 | 10/2006 | Ouyang | |
| 2008/0314192 | A1 | 12/2008 | Willemsen et al. | |
| 2010/0175497 | A1 | 7/2010 | Nozu et al. | |
| 2011/0197700 | A1 | 8/2011 | O'Neill | |

* cited by examiner

ELECTRONIC CLUTCH PEDAL ASSEMBLY HAVING VARYING RESISTANCE

CROSS-REFERENCE TO RELATED APPLICATIONS

This application claims priority to U.S. Provisional Patent Application Ser. No. 61/466,041 filed Mar. 22, 2011, the contents of which are incorporated herein by reference.

FIELD OF THE INVENTION

The present invention relates to an electronic clutch pedal assembly and, more particularly, an electronic clutch pedal assembly having varying resistance.

BACKGROUND OF THE INVENTION

Recently electrically controlled clutch assemblies have been designed. Such assemblies use an external source, such as an electric motor, to move a pressure plate into and out of engagement with a clutch disc. The use of an electric motor to move the pressure plate eliminates the need of a mechanical linkage between the clutch pedal and the clutch assembly. Such a system allows for the "free rolling" of the drive train which improves fuel economy by removing efficiency losses in an unpowered drive train (e.g. the transmission in the neutral position while in motion but not under power). As the system no longer requires the mechanical linkage between the clutch pedal and the clutch assembly, the system allows for an electronic or "fly-by-wire" type clutch pedal assembly.

In previously known electronic clutch pedal assembly a position sensor is used to sense the movement of the pedal arm to a position where the clutch would disengage to permit shifting. However, a significant drawback of these previously known electronic clutch pedal assemblies is that removal of the mechanical linkage between the pedal and the clutch assembly removes the resistance or "pedal feel" that a driver is typically accustomed to sense during clutch operation. As shown in FIG. 1, the dashed line L1 illustrates a force curve of a conventional clutch pedal assembly having a mechanical linkage between the clutch pedal and the clutch assembly. The conventional force curve rises slowly to a peak of about 50% of the travel path of the clutch pedal at which point the disengagement of the pressure plate with the clutch disc occurs. Upon the disengagement of the pressure plate with the clutch disc, the force curve tapers until the end of the travel path. Thus, it is desirable to provide an electronic clutch pedal assembly which provides a realistic "pedal feel" in which resistance rises until the disengagement point and resistance decreases after the disengagement point.

SUMMARY OF THE INVENTION

The present invention provides an electronic clutch pedal assembly for use with an automotive vehicle, which overcomes the above mentioned problems of the previously known electronic clutch pedal assemblies.

In brief, the electronic clutch pedal assembly includes a housing bracket for mounting the pedal assembly to the vehicle, a pedal arm, and a biasing device. The pedal arm includes an upper end and a pedal pad at a lower end. The upper end of the pedal arm is pivotally supported within the housing bracket for movement along a pedal path between an undepressed position and a depressed position. The biasing device includes a first end cap pivotally attached to the housing bracket and a second end cap pivotally attached to the pedal arm. The biasing device includes a compressible member disposed between the first end cap and the second end cap. The compressible member biases the pedal arm towards the undepressed position. Upon depression of the pedal arm from the undepressed position towards the depressed position, the compressible member is compressed as the biasing device rotates so as to vary the resistance of the compressible member along the pedal path.

One advantage of the present invention is that the electronic clutch pedal assembly is provided with a biasing device that is both rotatable and compressible. The simultaneous rotation of the biasing device and the compression of the compressible member varies the resistance over the pedal path so as to provides a" clutch pedal which accurately simulates the "pedal feel" of a clutch pedal having a mechanical clutch linkage.

BRIEF DESCRIPTION OF THE DRAWINGS

A better understanding of the present invention will be had upon reference to the following detailed description when read in conjunction with the accompanying drawings, wherein like reference characters refer to like parts throughout the several views and in which.

DETAILED DESCRIPTION OF THE INVENTION

Figure 1:
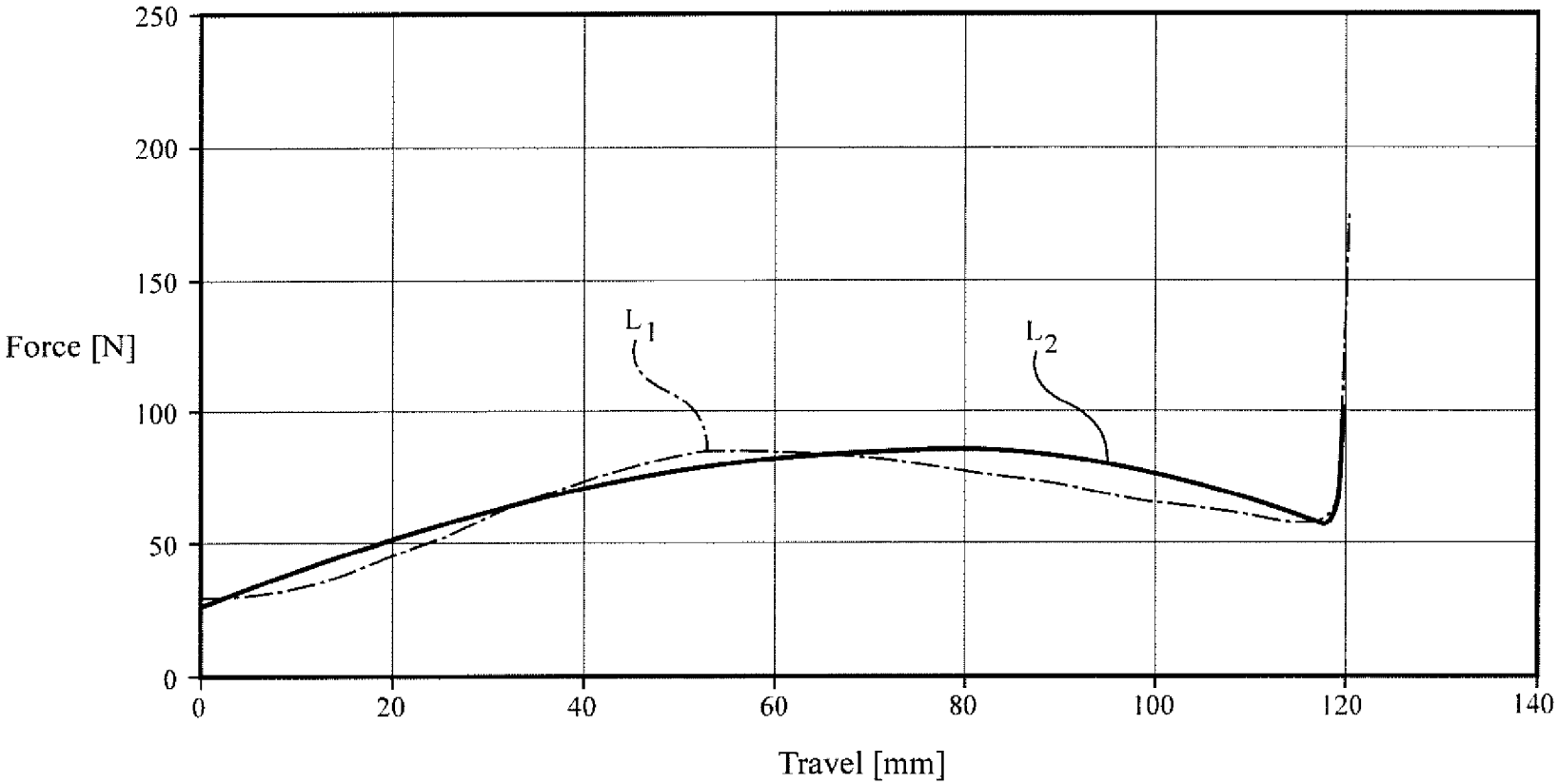
FIG. 1 is a graphical representation of a force curve for a mechanically linked clutch pedal and the inventive electronic clutch pedal assembly.

The present invention has utility as an electronic clutch pedal assembly for use with an automotive vehicle which overcomes the above mentioned disadvantages. The inventive electronic clutch pedal assembly includes a biasing device which simulates the feel of a clutch pedal having a conventional mechanical linkage to a clutch assembly. The biasing device includes a compressible member disposed between a first end cap and a second end cap. The first end cap is pivotally attached to a housing bracket and the second end cap is pivotally attached to a pedal arm. During depression of the pedal arm, the simultaneous rotation of the biasing device and the compression of the compressible member provide a variable pedal resistance over the pedal path which simulates a clutch pedal assembly having a conventional mechanical linkage.

With reference to FIGS. 1-4, a first embodiment of an electronic clutch pedal assembly is generally illustrated at 10. The clutch pedal assembly 10 includes a housing bracket 12 for mounting the pedal assembly 10 to a portion of the automotive vehicle. In the illustrated example, the housing bracket 12 is attached to a portion of the firewall (not shown) of the vehicle.

The housing bracket 12 includes a base portion 14, a pair of side walls 16, and a traverse upper portion 18 which extends between the pair of side walls 16. The base portion 14 includes at least one aperture 20 for securing the housing bracket 12 to the vehicle using any known fastener or attaching means to secure one object to another illustratively including bolting, screwing, welding, or adhesive.

The housing bracket 12 has a generally boxlike structure having an interior defined by the base portion 14, pair of side walls 16, and the traversing upper wall 18. The housing bracket 12 includes an opening 22 for receiving a pivot support member 24 and an opening 26 through which a portion of a pedal arm 28 extends. The pivot support member 24 includes snap tabs 23 disposed on either side of the pivot support member 24. The snap tabs 23 correspond to notches 25 formed on the side walls 16 to receive the snap tabs 23 in order for the pivot support member 24 to have a snap fit engagement with the housing bracket 12.

The pedal arm 28 includes a lower end 30 having a pedal pad 32 and an upper end 34 which is pivotally supported within the housing bracket 12. A portion of the pedal arm 28 adjacent the upper end 34 extends through the opening 26 of the housing bracket 12.

The pedal arm 28 includes a pair of spaced apart and parallel tongs 36 is formed at the upper end 34 of the pedal arm 28. The pair of tongs 36 defines a cavity 38 therebetween. Each of the pair of tongs 36 includes an outwardly extending generally circular boss 40. Each of the pair of circular bosses 40 extends outwardly beyond the exterior surface of each of the pair of tongs 36 in the vehicle width direction. The circular bosses 40 define outer circumferential walls 41.

Figure 2:
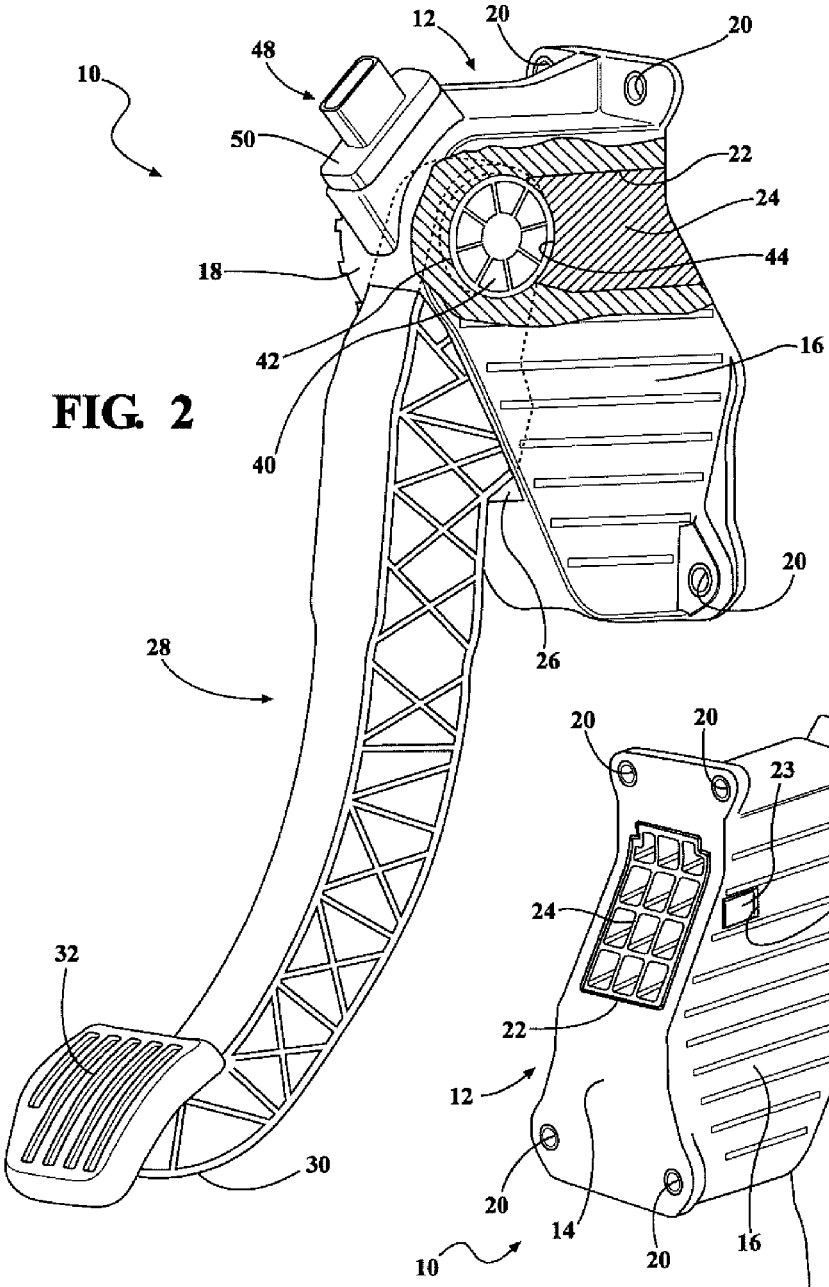
FIG. 2 is a front side perspective of the inventive pedal assembly.
Figure 3:
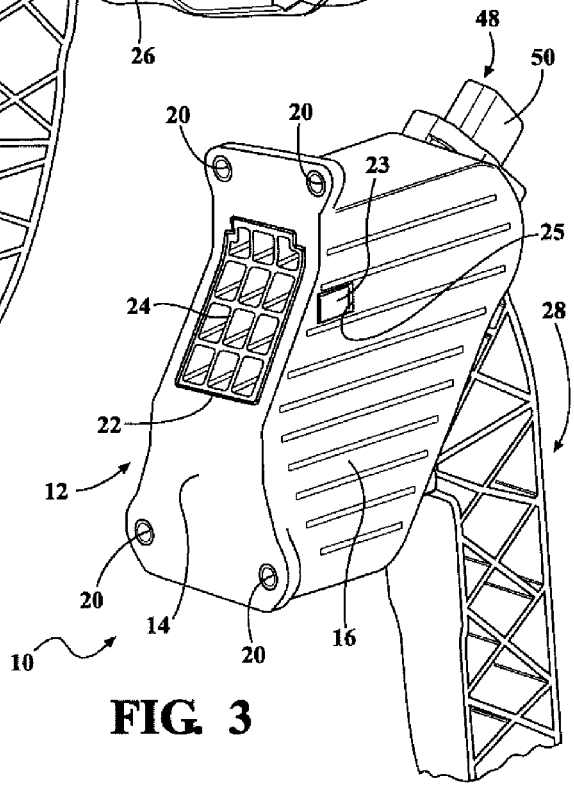
FIG. 3 is a rear side perspective of the inventive pedal assembly.

As seen in FIG. 2, the interior of the housing bracket 12 includes a pair of spaced apart semi-circular forward bearing surfaces 42 formed on a forward side of the upper wall 18 in a vehicle longitudinal direction. The forward bearing surfaces 42 are formed opposite the opening 22.

Figure 5:
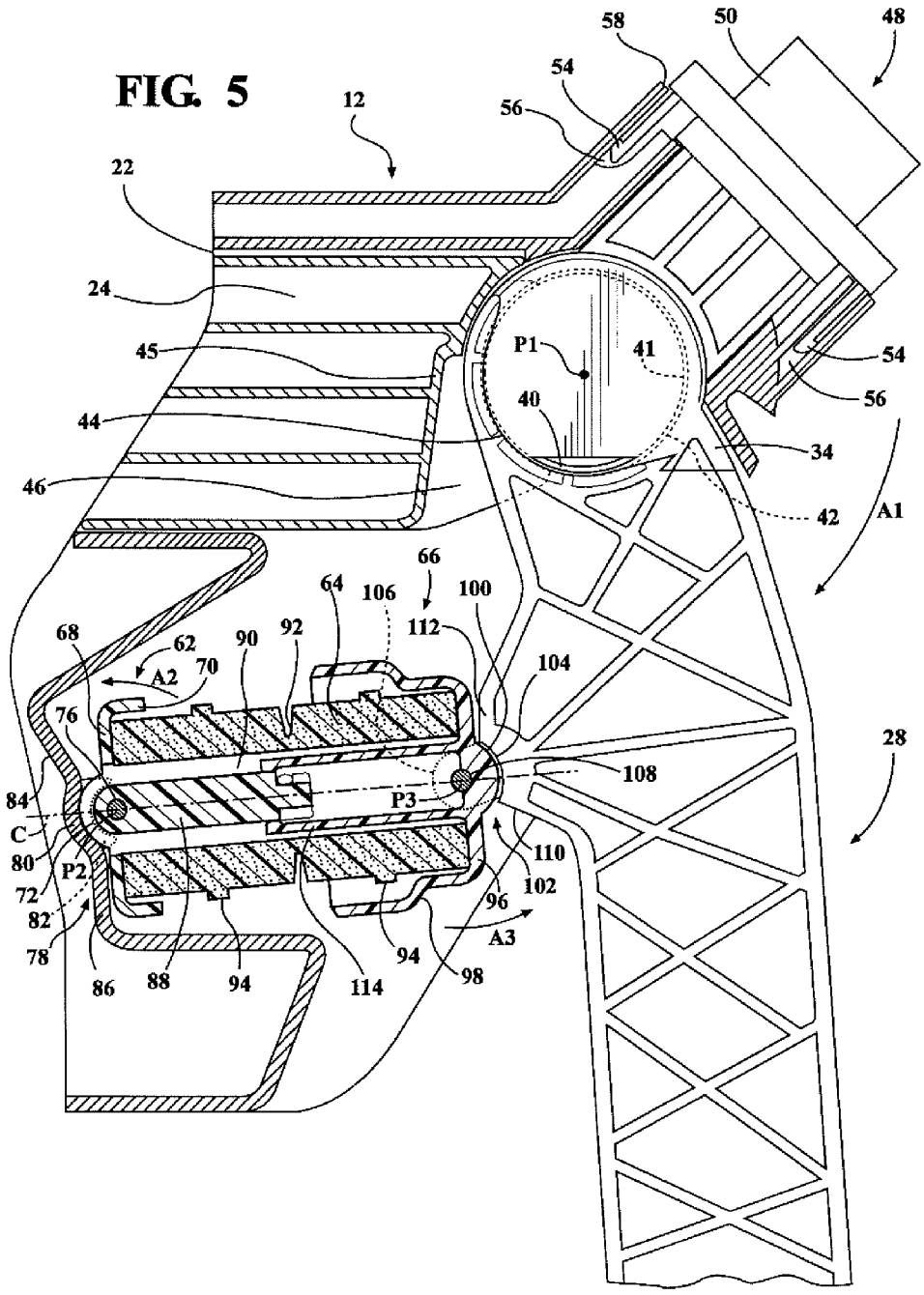
FIG. 5 is a partial cross-sectional view illustrating the pedal assembly with the pedal arm in the undepressed position.
Figure 6:
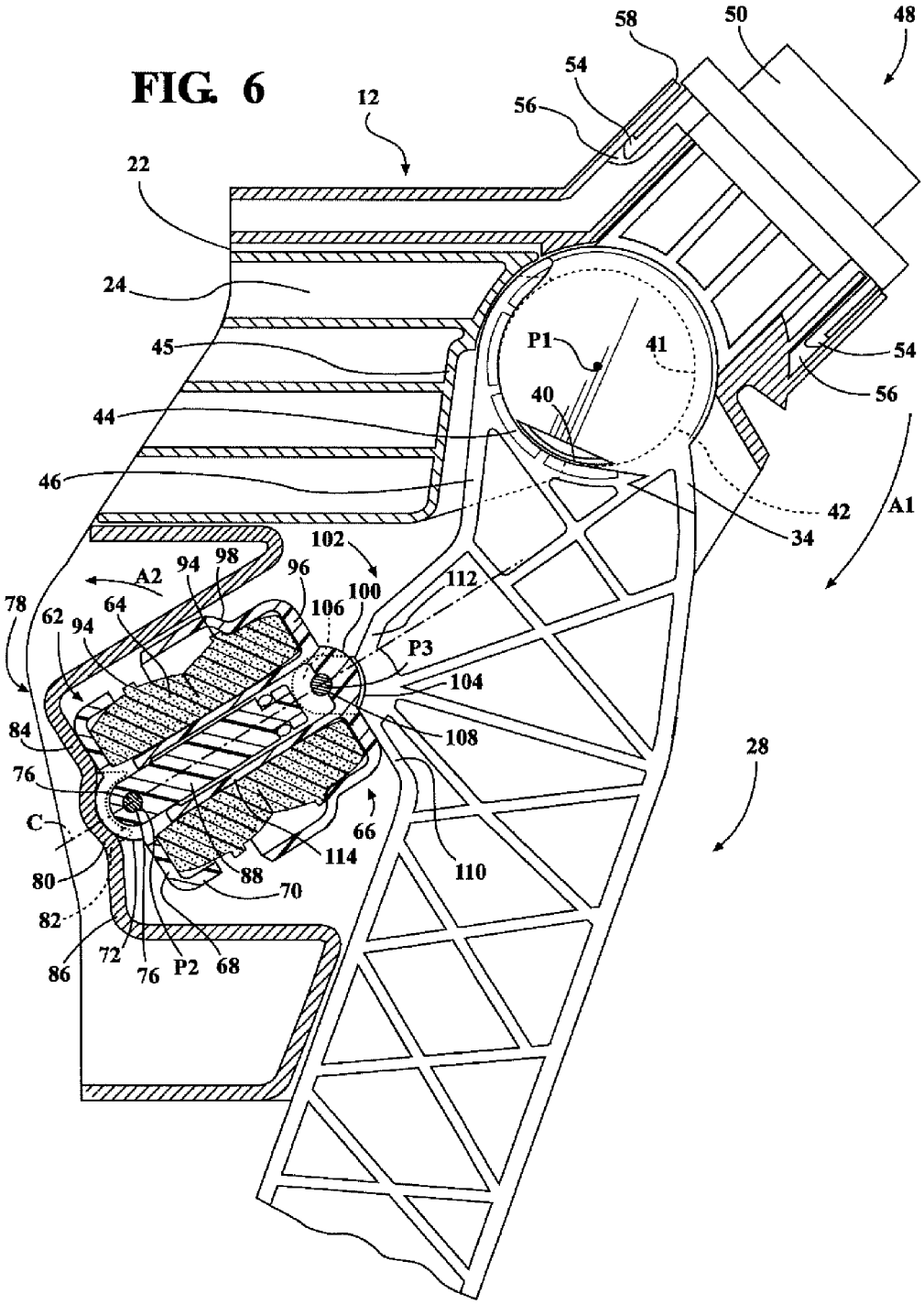
FIG. 6 is a partial cross-sectional view illustrating the pedal assembly with the pedal arm in the depressed position.
Figure 7:
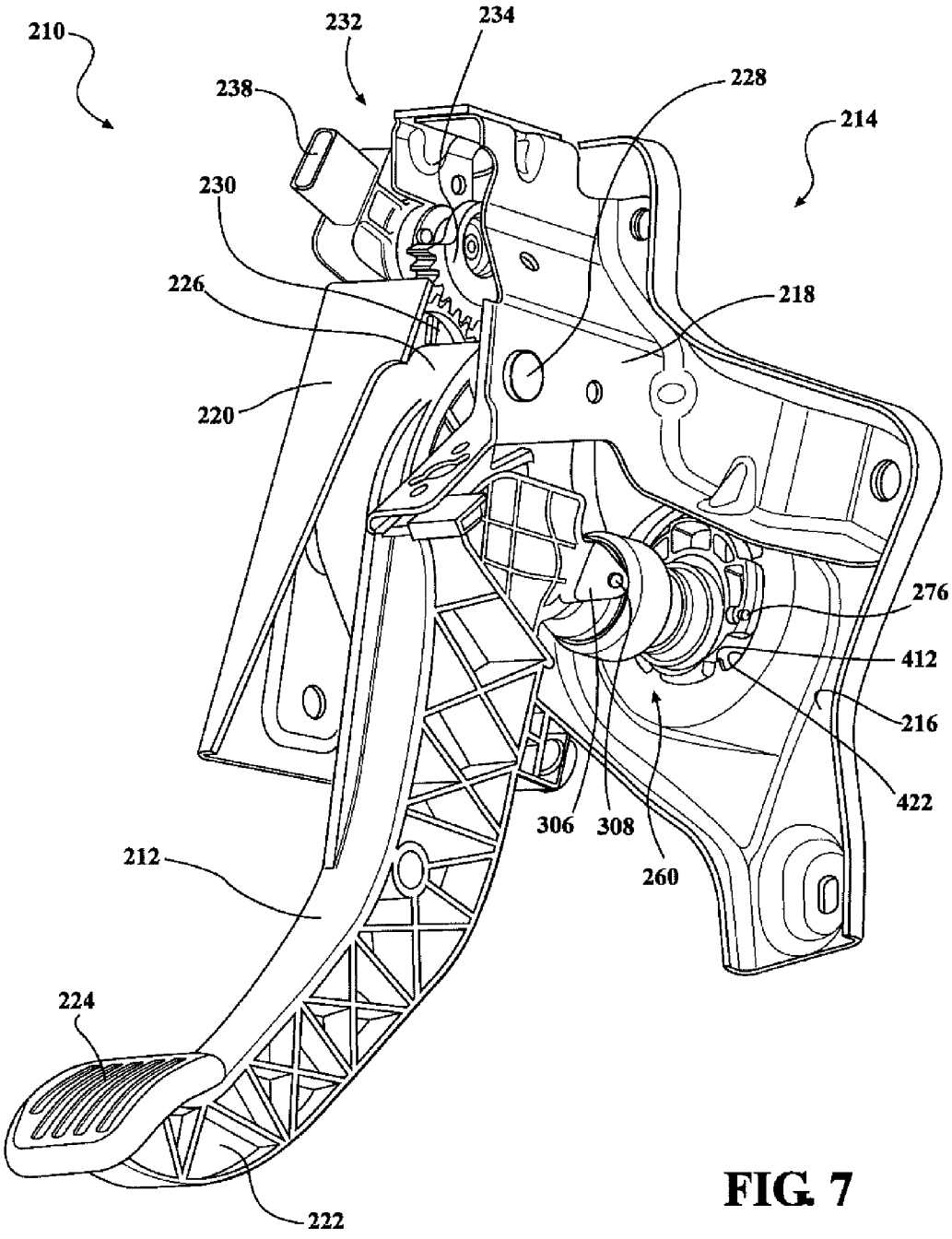
FIG. 7 is a side perspective view illustrating an alternative embodiment of the inventive pedal assembly.
Figure 8:
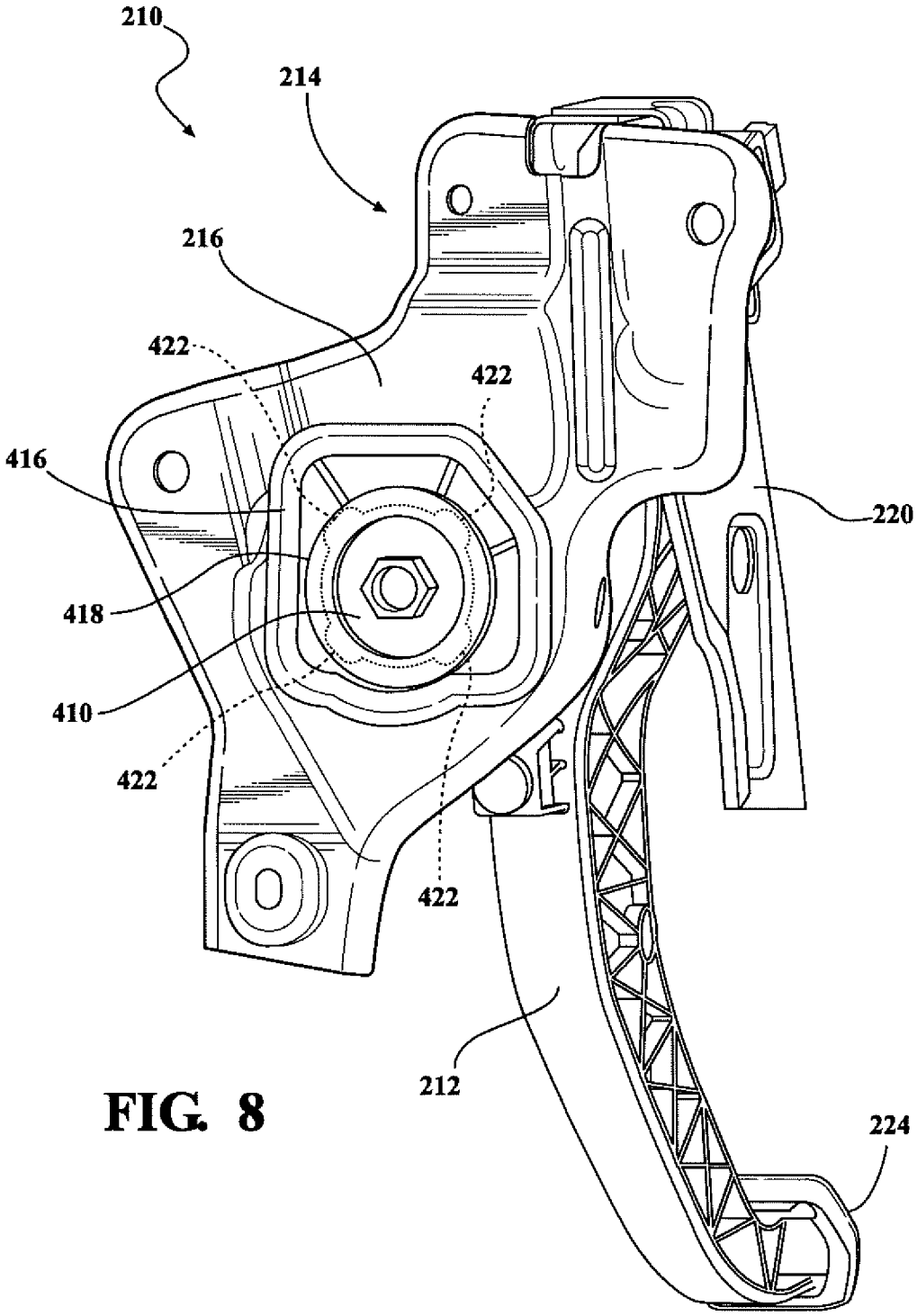
FIG. 8 is a rear perspective view of the alternative embodiment of the inventive pedal assembly.
Figure 9:
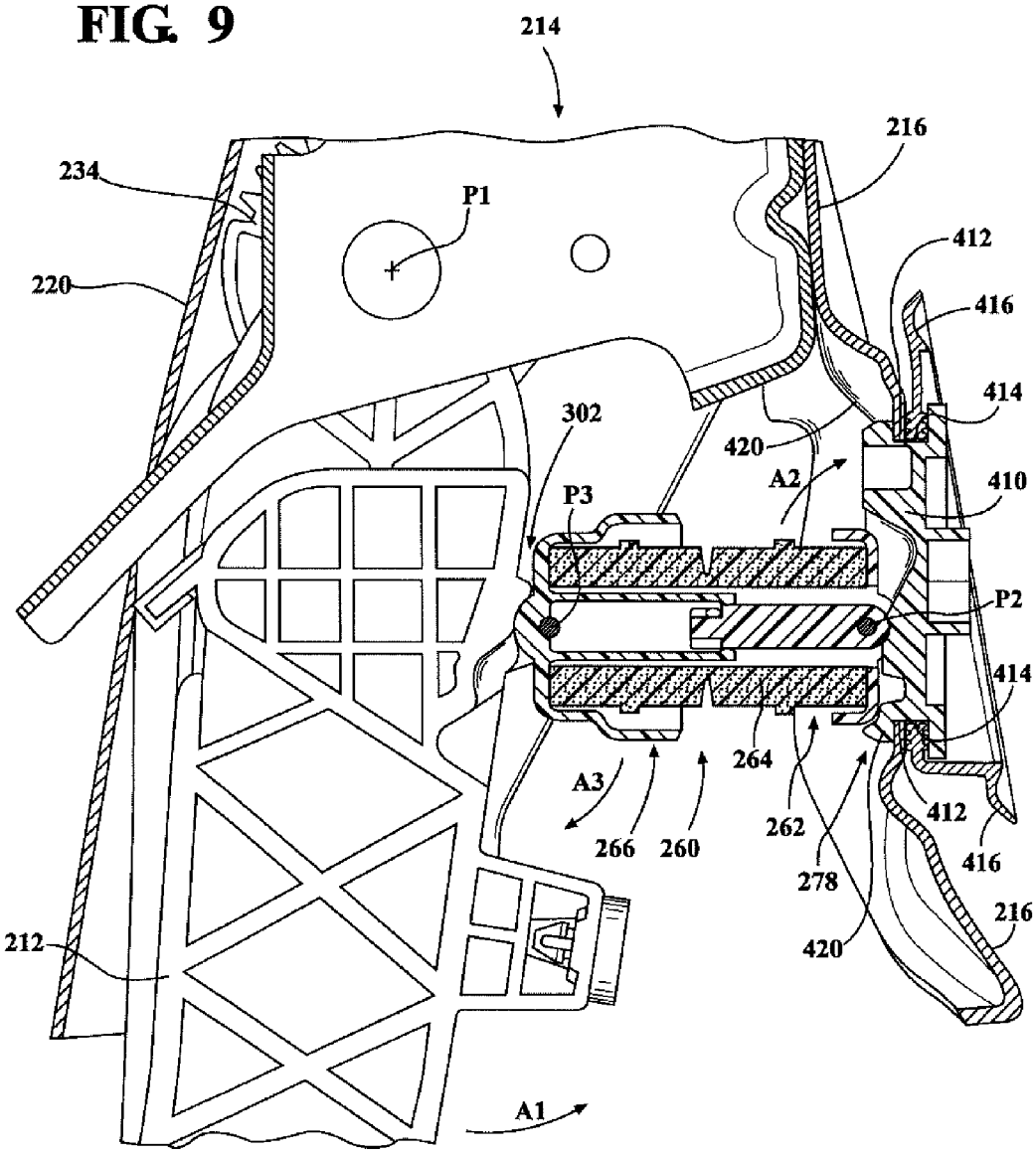
FIG. 9 is a partial cross-sectional view of the alternative pedal assembly with the pedal arm in the undepressed position.
Figure 10:
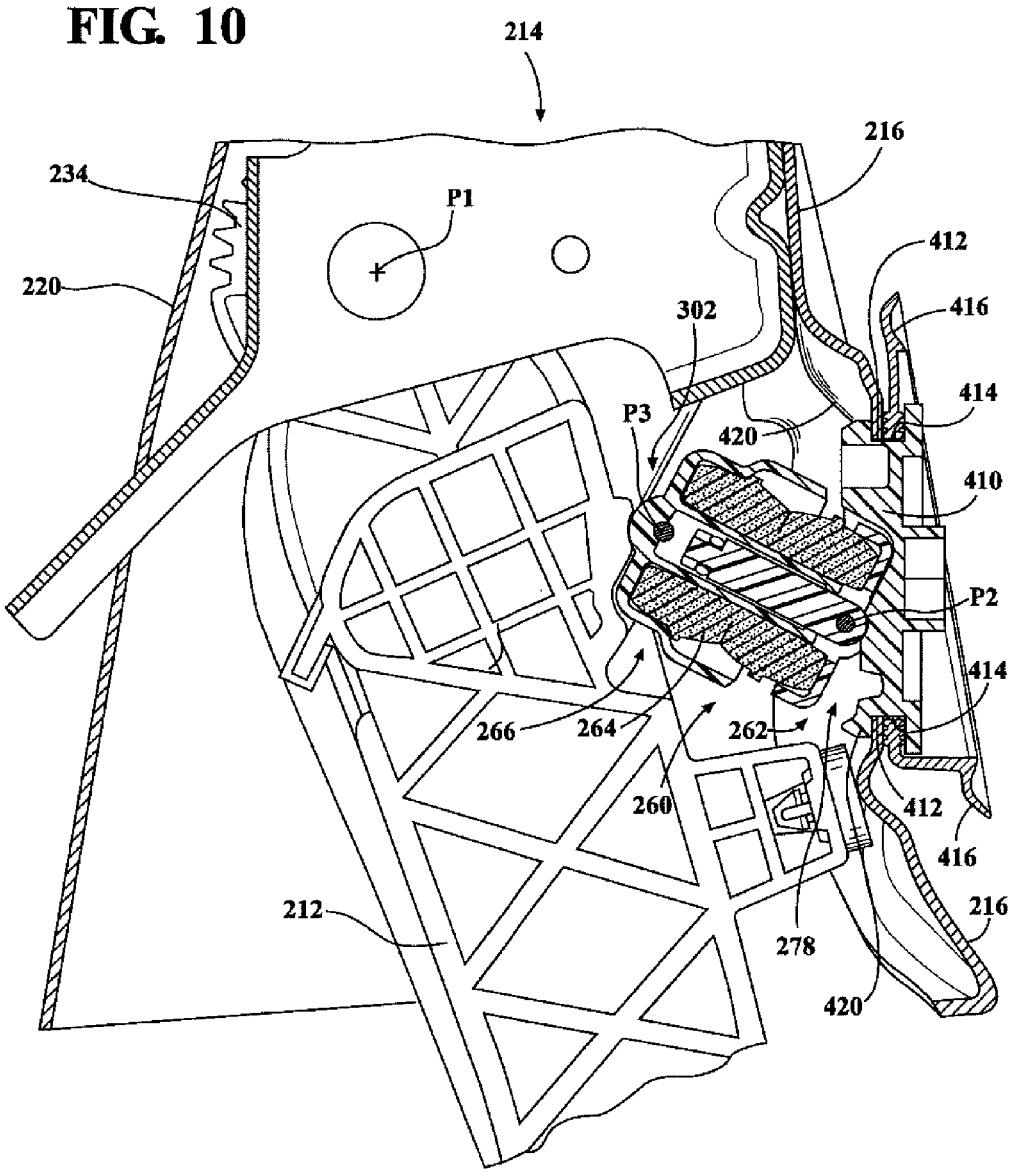
FIG. 10 is a partial cross-sectional view illustrating the alternative pedal assembly with the pedal arm in the depressed position.

The pivot support member 24 includes a pair of spaced apart semi-circular rear bearing surfaces 44 formed on a pair of shoulders 46 extending from either side of a base 45. The rear bearing surfaces 44 are formed on a rear side of the pivot support member 24 in the vehicle longitudinal direction. The rear bearing surfaces 44 and the forward bearing surfaces 42 have a radius of curvature corresponding to the radius of the circular bosses 40 disposed on the exterior sides of each of the pair of tongs 36. Each of the pair of bosses 40 is pivotally supported between the pivot support member 24 and the housing bracket 12. Specifically, the outer circumferential walls 41 of the pair of bosses 40 are pivotally supported between the rear bearing surfaces 44 and the forward bearing surfaces 42 such that the pedal arm pivots about a pivot axis P1. The pivotal support of the outer circumferential walls 41 of the bosses 38 between the forward bearing surfaces 42 and the rear bearing surfaces 44 allows the pedal arm 28 to pivot about pivot axis P1 along a pedal path between an undepressed position, as best seen in FIGS. 2 and 5, and a depressed position, as best seen in FIG. 6.

The rotation of the pedal arm 28 about the pivot axis P1 is sensed by a position sensor 48, such as a noncontacting position sensor. The position sensor 48 includes a plug 50 disposed at one end and a sensing portion 52 at an opposite end. The plug 50 connects to a wiring harness for transmission of a position signal detected by the sensing portion 52 in response to the movement of the pedal arm 28 about the pivot axis P1. The wiring harness transmits the position signal to a electronic control unit which controls an electric motor for movement of the pressure plate into and out of engagement of the clutch disc.

A plurality of tabs 54 extend from the plug 50 and engage within recesses 56 formed in the housing bracket 12 upon insertion of the position sensor 48 into a slot 58. The slot 58 is formed in the upper wall 18 of the housing bracket 12. The slot 58 is formed so as to correspond with the cavity 38 formed between the pair of tongs 36 such that upon insertion of the position sensor 48 into the slot 58 the sensing portion 52 is disposed between the pair of tongs 36, as best seen in FIG. 4.

The sensing portion 52 includes exiting coils and circuitry which produce an eddy current in a receiver coil. A blocker is mounted on the interior surface of the pair of tongs 36 adjacent the sensing portion 52. The blocker blocks a signal from the exiting coil in proportion to a rotation of the pedal arm 28 about pivot axis P1 to produce the position signal which is proportioned to the rotation and indicative of the displacement of the pedal arm 28. The position signals generated by the position sensor 48 are transferred to the vehicle controls via the plug 50 and a wiring harness attached to the plug 50. It is appreciated, of course, that various other types of positioning sensors may be utilized without deviation from the scope of the invention.

Figure 4:
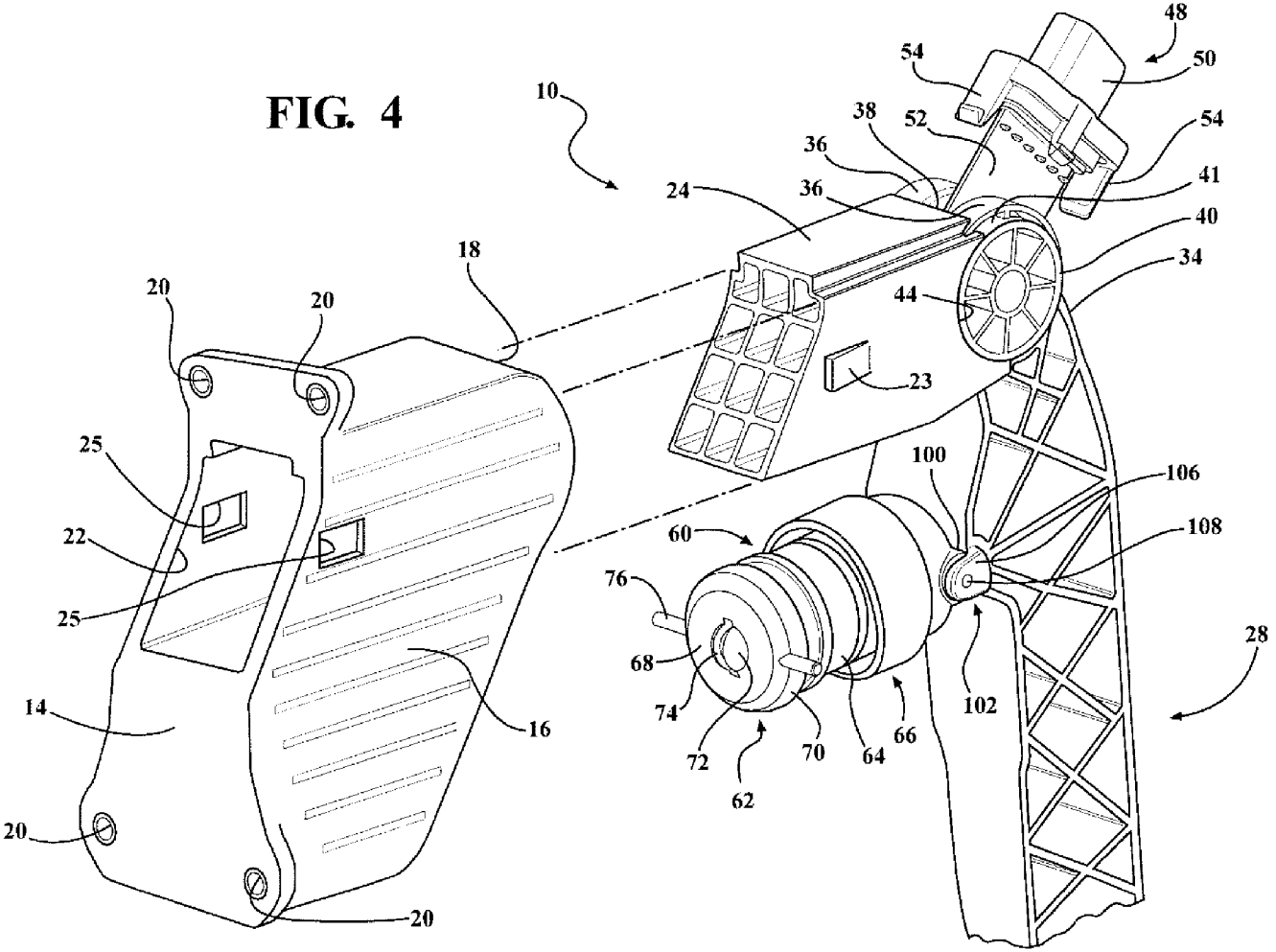
FIG. 4 is a partially exploded rear side perspective view of the pedal assembly.

With reference to FIGS. 4-6, the pedal assembly 10 includes a biasing device 60 for biasing the pedal arm 28 towards the undepressed position. The biasing device 60 is operable to realistically simulate a clutch pedal having a mechanical linkage by providing a variable pedal resistance over the pedal path from the undepressed position towards the depressed position. Specifically, as shown in FIG. 1, the solid line L2 illustrates the force curve for the pedal assembly 10 having the biasing device 60. The biasing device 60 provides a generally increasing resistance against pedal depression as the pedal is depressed from an initial (undepressed) position towards a disengagement point, generally 70 mm, at which the position, an electronic motor will disengage the pressure plate from the clutch disc based upon a position signal from the position sensor 48. After the disengagement point, the biasing device 60 provides a generally decreasing pedal resistance along the remainder of the pedal path. Accordingly, the biasing device 60 provides a variable pedal resistance over the pedal path in which the force curve L2 increases towards the disengagement point and decreases after the disengagement point to the remainder of the pedal path.

The biasing device 60 includes a first end cap 62, a biasing member 64, and a second end cap 66. The first end cap 62 includes a generally circular member 68 and a retaining wall 70 bounding the circumferential edge of the first circular member 68. A first lobe 72 extends from the exterior surface of the circular member 68 of the first end cap 62. The first lobe 72 has a generally semi-spherical shape having a slot 74 bisecting the first lobe 72. The first end cap 62 is pivotally supported by a pivot pin 76 to the interior portion of the housing bracket 12 so as to pivot within the first support portion 78 about pivot axis P2. Specifically, the interior portion of the housing bracket 12 includes a first support portion 78 formed as a depression or groove 80 having a corresponding shape to the first lobe 72. The first support portion 78 includes a first protrusion 82 that extends generally outwardly from the first groove 80 such that upon engagement of the first lobe 72 with the first support portion 78, the first protrusion 82 is received within the first slot 74.

The first support portion 78 includes a first angled wall 84 positioned above the first groove 80 and a first vertical wall 86 positioned below the first groove 80. The first angled wall 84 and the first vertical wall 86 provide rotational limits to the biasing device 60 as described in greater detail below. The first end cap 62 includes a first shaft 88. The first shaft 88 extends outwardly from the first circular member 68 on an interior surface which is opposite the exterior surface on which the first lobe 72 is formed.

The compressible member 64 is a generally cylindrically shaped having a hollow interior 90 and is compressible along a compressible axis C. In the illustrated embodiment the biasing member 64 is formed of electrometric material and functions as a "rubber spring". It is appreciated, of course, that the compressible member is not limited to such a configure and illustratively includes coil springs and double coils springs.

The compressible member 64 extends along the compressible axis C coaxially with the first shaft 88. The compressible member 64 includes a thinned portion 92 extending towards the hollow interior 90. The thinned portion 90 is positioned at the central portion of the compressible member 64 along the compressible axis C. The compressible member 64 further includes bulge portions 94 which allow for the increase in the circumferential diameter of the compressible member 64 during compression. The thinned portion 92 allows for a controlled decrease in length of the compressible member 64 during compression. The compressible member 64 is positioned between the first end cap 62 and the second end cap 66.

The second end cap 66 includes a generally circular second member 96 having a stepped wall 98 extending outwardly from the circumferential edge of the first circular member 96. The stepped wall 98 is expanded radially outwardly in a stepped manner so as to provide the stepped portion of the stepped wall 98 with a radius greater than the radius of the first circular member 68. Providing the stepped portion of the stepped wall 98 with a radius greater than the radius of the first circular member 68 allows for the second end cap, specifically the stepped wall 98, to accommodate for the increase in width of the compressible member 64 and to envelope the wall 70 of the first cap member 62.

A second lobe 100 extends from an exterior surface of the second circular member 96 and engages with a second support portion 102 formed on the pedal arm 28. The second lobe has an elongated semi-circular shape extending in the vehicle width direction across the length of the second circular member 96. The second support portion 102 includes a second groove 104 having a shape corresponding to the elongated semi-circular shape of the second lobe 100. Specifically, the second groove 104 has a radius corresponding to the radius of the second lobe 100 to allow for pivotal movement of the second lobe 100 within the second groove 102.

The second support portion 102 is provided between the upper end 34 and the lower end 30 of the pedal arm 28. A pair of tabs 106 extend from either side of the pedal arm 28 so as to connect to either end of the second lobe 100. A pivot pin 108 extends through the pair of tabs 106 and the second end cap 66 such that the second end cap 66 is pivotally supported within the second support portion 102 about pivot axis P3. The second support portion 102 includes a second angled wall 110 positioned below the second groove 104 and a second vertical wall 112 positioned above the second groove 104. The second angled wall 110 and second vertical wall 112 act as limits to the pivotal rotation of the biasing device 60.

The second end cap 66 includes a hollow second shaft 114. The hollow second shaft 114 extends outwardly from the second circular member 96 on an interior surface which is opposite the exterior surface on which the second lobe 100 is formed. The hollow second shaft 114 extends along the compressible axis C coaxially with the first shaft 88 and the compressible member 64. The hollow second shaft 114 slidably receives a distal portion of the first shaft 88.

As the first shaft 88 is slidably received within the hollow interior of the second shaft 114, the compressible member 64 is prohibited from deforming or compressing in a direction other than along the compressible axis C defined by the coaxial relationship of the compressible member 64, the first shaft 88, and the second shaft 114.

In order to facilitate a better understanding of the first embodiment of the present invention, the operation of the pedal assembly 10 will now be described. During clutch pedal operation a driver actuates the clutch pedal assembly 10 by depressing the pedal pad 32. The depression of the pedal pad 32 causes the pedal arm 28 to pivot about the pivot axis P1 as the pair of bosses 40. The bosses 40 rotate guided by the first bearing surface 42 and the second bearing surface 44 of the pivot support member 24. The rotation of the bosses 40 within the first bearing surface 42 and the second bearing surface 44 causes the pedal arm 28 to pivot which compresses the biasing device 60 in the direction of arrow A1.

As the pedal arm 28 is moved along the pedal path, the biasing device 60 will simultaneously rotate about pivot axes P2 and P3 and will compress along the central compression axis defined by the compressible member 64 and the first shaft 88 and the second shaft 114. Specifically, the second cap 66 will rotate about pivot axis P3 in the direction of arrow A3 such that the second lobe 100 pivots within the second groove 104. The first end cap 62 will pivot within the first pivot support portion 78 along the direction of arrow A2. Specifically, the first lobe 72 will pivot within the first groove 80. It is appreciated, of course, that the pivotal direction A2 of first end cap 62 is opposite from the pivotal direction A3 of the second end cap 66.

As the pedal arm 28 is depressed from the undepressed position towards the depressed position, the rotation of the biasing device 60 and the simultaneous compression of the compressible member 64 provide the variable resistance as disclosed in the force curve L2 of FIG. 1 such that upon reaching the disengagement point in the pedal path, the biasing device 60 will switch from an increasing resistance to a decreasing resistance as the biasing device 60 has rotated from the generally horizontal position as shown in FIG. 5 to the generally angled position of FIG. 6. At or near the depressed position the first angled wall 84 acts as a limit of rotation for the first end cap 62 in which the exterior surface will abut the first angled wall 84 to limit further pivotal movement of the first end cap. The second angled wall 110 similarly will limit the pivotal rotation of the second end cap 66 by contact between the exterior surface of the second circular member 96 and the second angled wall 110. As the directions of pivotal rotation of the first end cap 62 and the second end cap 66 are in opposite directions, the first angled wall 80 is positioned above the first groove 80 and the second angled wall 110 is positioned below the second groove 104.

With reference to FIGS. 7-11, an alternative embodiment of the inventive electronic clutch pedal assembly having the variable pedal resistance is generally illustrated at 210. The second embodiment of the pedal assembly 210 is designed to take advantage of the opening formed in the vehicle through which the conventional mechanical linkage would be placed.

The pedal assembly 210 includes a pedal arm 212 and a housing bracket 214 for mounting to the vehicle.

The housing bracket 214 is formed of a plurality of stamped metallic plates having a welded connection. It is appreciated, of course, that the mounting bracket 214 is not limited to such configuration and the housing bracket 214 is operable to be formed by connection in other manners illustratively including bolting, ultrasonic welding, and adhesive.

The housing bracket 214 includes a base portion 216 and a pair of side walls 218. The base portion 216 and the pair of side walls 218 and 220 include a plurality of fastener openings for connection to the vehicle. In the alternative, the base portion 216 is itself only mounted to the vehicle with the pair of side walls 218 mounted to the base portion 216.

The pedal arm includes a lower end 222 having a pedal pad 224 and an upper end 226 pivotally supported between the pair of side walls 218 by a pivot pin 228 about a pivot axis P1. The pedal arm 212 includes a pedal gear 230 extending outwardly from the upper end 226. The pedal gear 230 meshes with a position sensor 232, specifically a sensor gear 234. The position sensor 232 includes a plug 238 for attaching to a wiring harness and internal circuitry and coils. The sensor gear 234 is rotatable about an axis and in which depression of the pedal pad 224 will rotate the pedal arm 212 about the pivot pin 228 causing the pedal gear 230 to rotate the sensor gear 234. The rotation of the sensor gear 234 allows the position sensor 232 to transform the physical rotation to a position signal through the use of coils and circuitry. The position sensor 232 then transmits the position signal to a wiring harness connected to the plug 238 in order to operate the clutch assemble of the vehicle.

The pedal assembly 210 includes a biasing device 260 similar to the biasing device 60 of the first embodiment, and includes a first end cap 262, a compressible device 264, and a second end cap 266. The pedal assembly 210 includes a second support portion 302 similar to the second support portion 102 of the first embodiment, and a first support portion 378 of the second embodiment differs from the first support portion 78 of the first embodiment in that the first support portion 278 is provided on an insert 410.

Figure 11:
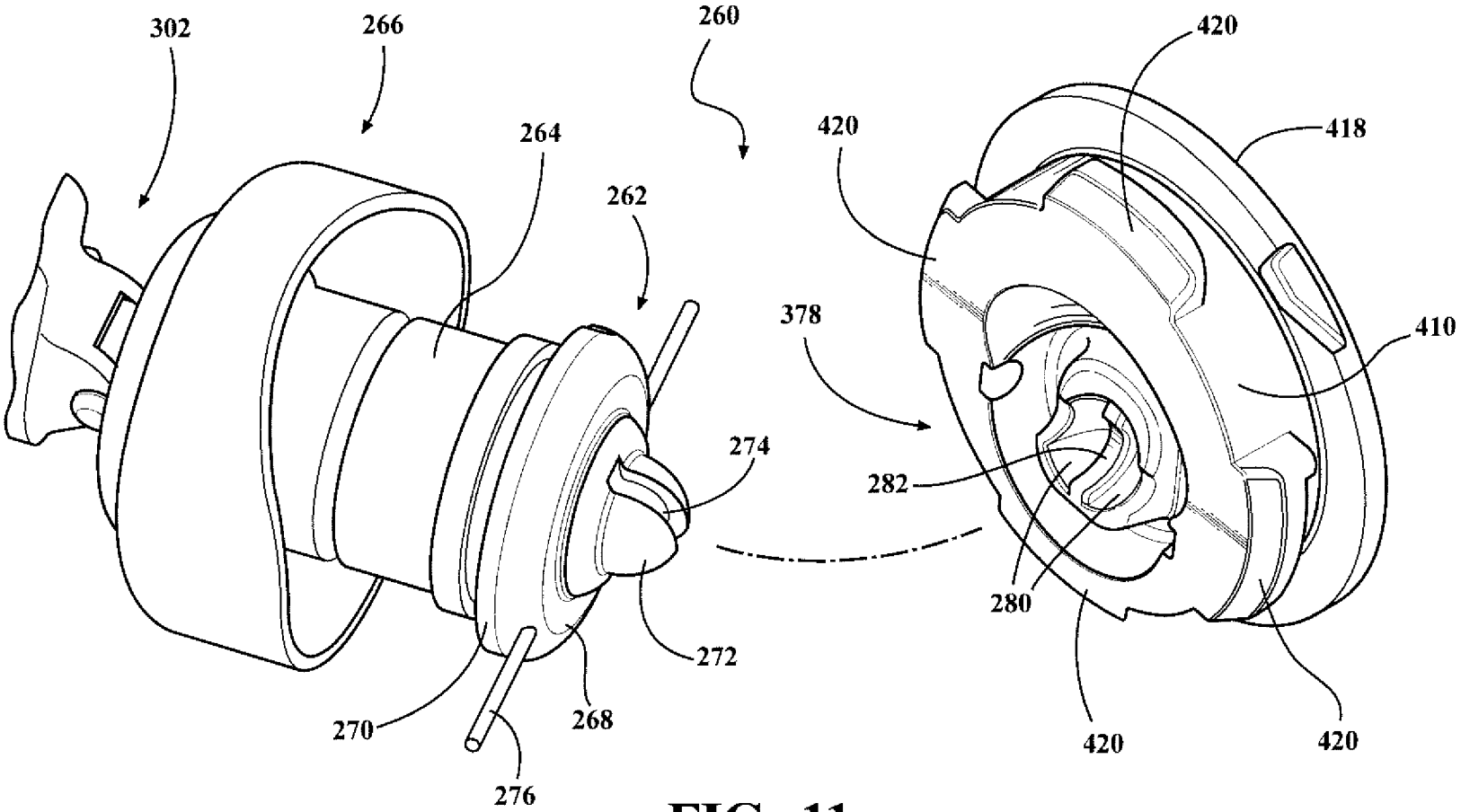
FIG. 11 is a partial perspective exploded view of the insert and the biasing device of the alternative pedal assembly.

As best seen in FIG. 11, the first end cap 262 includes a first lobe 272 extends from the exterior surface of a circular member 268 of the first end cap 62. The first lobe 272 has a generally semi-spherical shape having a slot 274 bisecting the first lobe 272. The first end cap 262 is pivotally supported by a pivot pin 276 to the insert 410 so as to pivot within the first support portion 278 about pivot axis P2. Specifically, the first support portion 278 is similar to the first support portion 78 except the first support portion 278 is formed on the insert 410. The first support portion includes a groove 280 having a semi-spherical shape corresponding to the semi-spherical shape of the first lobe 272. The first support portion 278 includes a first protrusion 282 that extends generally outwardly from the first groove 280 such that upon engagement of the first lobe 272 with the first support portion 278, the first protrusion 282 is received within the first slot 274.

The insert 410 is formed as a removable part from the base portion 216, and the first support portion 278 includes the first groove 280, the first angled wall 284, and the first vertical wall 286. The insert 410 is inserted through an aperture 412 formed in the base portion 216. The aperture 412 corresponds with an opening 414 formed in the vehicle 416 such as the firewall. The opening 414 is an opening for use with a conventional clutch pedal assembly having a mechanical linkage in which the mechanical linkage would extend through the opening 414. The insert 410 includes a generally circular shape having a flange 418 extending radially from a forward side in the vehicle longitudinal direction. The flange 418 extends beyond the diameter of the opening 414 and the aperture 412. A plurality of tabs 420 extend radially outward from a rearward side of the insert 410. The plurality of tabs 420 correspond with a plurality of cutouts 422 formed in the base portion 216 and the vehicle 416. The cutouts 422 extend inwardly from an edge of the aperture 416 and opening 414.

In order to install the insert 410 into the vehicle 416 and the base portion 216, the plurality of tabs 420 are aligned with the plurality of cutouts 422 and the rearward side of the insert 410 first enters the opening 414 of the vehicle and the aperture 416 of the base portion 216. Once the plurality of tabs 420 have passed through the aperture 412 and are beyond the rearward face of the base portion 216, the insert 410 is rotated such that the portion of the base portion 216 and the vehicle 416 is positioned between a forward surface of the plurality of tabs 420 and a rearward surface of the flange 262 to lock the insert 410 to the vehicle 414 and the base portion 216.

It is appreciated, of course, that the inventive pedal assemblies 10 and 210 are not limited to electronic clutch pedals. The inventive pedal assemblies 10 and 210 are optionally for use in controlling a vehicle operation illustratively including brake control, acceleration control, or any other operation which requires the pedal to stimulate the feel of a pedal having a mechanical linkage.

The present invention has been described in an illustrative manner. It is to be understood that the terminology which has been used is intended to be in the nature of words of description rather than of limitation. Many modifications and variations of the present invention are possible in light of the above teachings. Therefore, within the scope of the appended claims, the present invention may be practiced other than as specifically described.

It is claimed:

1. An electronic pedal assembly for use with an automotive vehicle, said pedal assembly comprising:

a housing bracket adapted for mounting said pedal assembly to the vehicle;

a pedal arm having a pedal pad at a lower end and an upper end pivotally supported within said housing bracket, said pedal arm operable to travel along a pedal path between an undepressed position and a depressed position;

an electronic position sensor that detects rotation of said pedal arm and transmits a position signal based on said detected rotation; and a biasing device having a first end cap, a second end cap and a compressible member disposed between said first end cap and said second end cap, said first end cap pivotally attached to said housing bracket, said second end cap pivotally attached to said pedal arm, said compressible member of said biasing device biases said pedal arm towards said undepressed position, said compressible member has a generally hollow cylindrical shape extending along an axis of compression, and one of said first end cap and said second end cap includes an outwardly extending shaft extending coaxial with the axis of compression, and an other of said first end cap and said second end cap includes an outwardly extending hollow shaft extending coaxial with said axis of compression, said hollow shaft slidably receives a portion of said shaft to prohibit said compressible member from compressing in a direction other than along said axis of compression;

wherein upon depression of said pedal arm from said undepressed position towards said depressed position said compressible member compresses, said biasing device rotates with said first end cap pivoting on said housing bracket and said second end cap pivoting on said pedal arm to provide a variable pedal resistance over said pedal path.

2. The electronic pedal assembly of claim 1, wherein said second end cap is pivotally attached to said pedal arm between said upper end and said lower end of said pedal arm.

3. The electronic pedal assembly of claim 1, wherein said first end cap is pivotally attached to said housing bracket at a first support portion, said first support portion having a shaped first groove formed in said housing bracket, and wherein said first end cap includes a first lobe having a shape corresponding to said first groove to allow for pivotal movement of said first lobe within said first groove.

4. The electronic pedal assembly of claim 3, wherein said first shaped groove is a semi-spherical groove having a protrusion bisecting said first groove, and wherein said first lobe is a semi-spherical lobe having a slot bisecting said first lobe, said first lobe received within said first shaped groove such that said protrusion extends within said slot, and wherein a first pivot pin extends through said first end cap and said first support portion to pivotally support said first lobe within said first groove.

5. The electronic pedal assembly of claim 3, wherein said second end cap is pivotally attached to said pedal arm at a second support portion, said second support portion having a shaped second groove formed in said pedal arm, and wherein said second end cap includes a second lobe having a shape corresponding to said second groove to allow for pivotal movement of said second lobe within said second groove.

6. The electronic pedal assembly of claim 5, wherein said second support portion includes a pair of tabs, one of said pair of tabs extending outwardly at either end of said second groove, and wherein a second pivot pin extends through said pair of tabs and second end cap to pivotally support said second lobe within said second groove.

7. The electronic pedal assembly of claim 6, wherein said first support portion includes a first angled wall positioned above said first groove, and wherein said second support portion includes a second angled wall positioned below said second groove;

wherein when said pedal arm is in said depressed position said first end cap abuts said first angled wall to limit pivotal movement of said first end cap with respect to said first support portion and said second end cap abuts said second angled wall to limit pivotal movement of said second end cap with respect to said second support portion.

8. The electronic pedal assembly of claim 7, wherein said housing bracket includes a pair of side walls extending from a base portion, said first support portion formed in said base portion of said housing bracket, and wherein said upper end of said pedal arm is pivotally supported between said pair of side walls.

9. The electronic pedal assembly of claim 8 further comprising:

an opening formed in said base portion;

a traverse upper wall extending between said pair of side walls;

a pair of spaced apart semi-circular first bearing surfaces are formed on a forward side of said upper portion in a vehicle longitudinal direction; and a pivot support member received within said opening, said pivot support member having a pair of spaced apart semi-circular second bearing surfaces formed on a rear side of said pivot support member in said vehicle longitudinal direction;

wherein said pedal arm includes a pair of generally circular bosses extending outwardly from each side of said upper end of said pedal arm in a vehicle width direction, said pair of bosses pivotally supported between said pair of first bearing surfaces and said pair of second bearing surfaces for pivotal movement of said pedal arm between said undepressed position and said depressed position.

10. The electronic pedal assembly of claim 9, wherein said upper end of said pedal arm is formed of a pair of spaced apart tongs defining a cavity therebetween, each one of said pair of tongs having one of said pair of bosses extending therefrom in said vehicle width direction;

wherein said upper wall having a slot corresponding with said cavity, and a position sensor extends through said slot and into said cavity between said pair of tongs to detect the rotational movement of said pedal arm.

11. The electronic pedal assembly of claim 5, wherein said housing bracket includes a removable insert and a base portion having an aperture configured to receive said insert, said first support portion formed on said insert;

wherein said housing bracket is mounted to the vehicle such that said aperture corresponds with an opening formed in the vehicle, wherein said insert is inserted within said aperture of said base portion and the opening in the vehicle to at least partially mount said pedal assembly to the vehicle.

12. The electronic pedal assembly of claim 11, wherein said insert has a generally circular shape having a flange extending radially from a forward side in a vehicle longitudinal direction, and a plurality of tabs extending radially from a rear side in said vehicle longitudinal direction, and wherein said aperture and the opening have a plurality of corresponding cutouts extending radially inwardly from an edge of said aperture and an edge of the opening, said plurality of cutouts of said aperture and the opening receive said plurality of tabs of said insert;

wherein upon insertion of said insert within said aperture and the opening said insert is rotated such that a portion of said base portion adjacent said aperture and a portion of the vehicle adjacent the opening is positioned between said plurality of tabs and said flange of said insert.

13. The electronic pedal assembly of claim 12, wherein said first support portion on said insert include a first angled wall positioned above said first groove, and wherein said second support portion on said pedal arm includes a second angled wall positioned below said second support portion;

wherein when said pedal arm is in said depressed position said first end cap abuts said first angled wall to limit pivotal movement of said first end cap with respect to said first support portion and said second end cap abuts said second angled wall to limit pivotal movement of said second end cap with respect to said second support portion.

14. The electronic pedal assembly of claim 13 further comprising an electronic sensor having a rotatable sensor gear;

wherein said pedal arm includes a pedal gear that meshes with said sensor gear, and wherein movement of said pedal arm rotates said sensor gear to detect the rotational movement of said pedal arm.

15. An electronic pedal assembly for use with an automotive vehicle, said pedal assembly comprising:

a housing bracket adapted for mounting said pedal assembly to the vehicle, said housing bracket having a first support portion, said first support portion having a first upper wall and a spaced apart first lower wall;

a pedal arm having a lower end having a pedal pad and an upper end pivotally supported within said housing bracket, said pedal arm operable to travel along a pedal path between an undepressed position and a depressed position;

an electronic position sensor that detects rotation of said pedal arm and transmits a position signal based on said detected rotation; and a biasing device having a first end cap, a second end cap and a compressible member disposed between said first end cap and said second end cap, said first end cap pivotally attached to said housing bracket at said first support portion between said first wall and said second wall, said first end cap having an exterior surface, said second end cap pivotally attached to said pedal arm, said compressible member of said biasing device biases said pedal arm towards said undepressed position;

wherein when said pedal arm is in said undepressed position said exterior surface of said first end cap contacts one of said first upper wall and said first lower wall to limit pivotal movement of said first end cap with respect to said first support portion, and wherein when said pedal arm is in said depressed position said exterior surface of said first end cap contacts an other of said first upper wall and said first lower wall to limit pivotal movement of said first end cap with respect to said first support portion;

wherein upon depression of said pedal arm from said undepressed position towards said depressed position said compressible member compresses, said biasing device rotates with said first end cap pivoting on said housing bracket and said second end cap pivoting on said pedal arm to provide a variable pedal resistance over said pedal path.

16. The electronic pedal assembly of claim 15, wherein said pedal arm includes a second support portion having a second upper wall and a second lower wall, said second end cap being pivotally attached to said second support portion between said second upper wall and said second lower wall, said second end cap having an exterior surface;

wherein when said pedal arm is in said undepressed position said exterior surface of said second end cap contacts one of said first upper wall and said second lower wall to limit pivotal movement of said second end cap with respect to said second support portion, and wherein when said pedal arm is in said depressed position said exterior surface of said second end cap contacts an other of said second upper wall and said second lower wall to limit pivotal movement of said second end cap with respect to said second support portion.

17. The electronic pedal assembly of claim 15, wherein said first support portion includes a first semi-spherical groove formed between said first upper wall and said first lower wall, said first semi-spherical groove includes a protrusion bisecting said first semi-spherical groove, wherein said first end cap includes a first semi-spherical lobe having a slot bisecting said first semi-spherical lobe, and wherein a first pivot pin extends through said first end cap and said first support portion to pivotally support said first semi-spherical lobe within said first semi-spherical groove.

18. The electronic pedal assembly of claim 17, wherein said second support portion includes a shaped second groove formed between said second upper wall and said second lower wall, said second support portion includes a pair of tabs, one of said pair of tabs extending outwardly at either end of said second groove, wherein said second end cap includes a second lobe having a shape corresponding to said second groove to allow for pivotal movement of said second lobe within said second groove, and wherein a second pivot pin extends through said pair of tabs and second end cap to pivotally support said second lobe within said second groove.

19. The electronic pedal assembly of claim 15, wherein said housing bracket includes a removable insert and a base portion having an aperture configured to receive said insert, said first support portion formed on said insert.

20. An electronic pedal assembly for use with an automotive vehicle, said pedal assembly comprising:

a housing bracket adapted for mounting said pedal assembly to the vehicle;

a pedal arm having a lower end and an upper end, said upper end positioned above said lower end with respect to a vertical direction, said lower end having a pedal pad, said upper end pivotally supported within said housing bracket, said pedal arm operable to travel along a pedal path between an undepressed position and a depressed position;

an electronic position sensor that detects rotation of said pedal arm and transmits a position signal based on said detected rotation; and a biasing device having a first end cap, a second end cap and a compressible member disposed between said first end cap and said second end cap, said first end cap pivotally attached to said housing bracket, said second end cap pivotally attached to said pedal arm, said compressible member of said biasing device biases said pedal arm towards said undepressed position;

wherein upon depression of said pedal arm from said undepressed position towards said depressed position said compressible member compresses, said biasing device rotates with said first end cap pivoting on said housing bracket and said second end cap pivoting on said pedal arm to provide a variable pedal resistance over said pedal path.

* * * * *